United States Patent [19]

Curtis et al.

[11] Patent Number: 5,046,213

[45] Date of Patent: Sep. 10, 1991

[54] PLAQUE REMOVING TOOTHBRUSH

[75] Inventors: John P. Curtis, Bloomsbury; Kedar N. Rustogi, Kendall Park, both of N.J.; John C. Crawford, Lake Mahopac, N.Y.; James H. Kemp, Piscataway, N.J.; Thomas E. Mintel, Rahway, N.J.; Bert D. Heinzelman, Tenafly, N.J.; Donald R. Lamond, Lynbrook; Laura H. Edelman, New York, both of N.Y.

[73] Assignee: Colgate-Palmolive Company, Piscataway, N.J.

[21] Appl. No.: 501,454

[22] Filed: Mar. 29, 1990

[51] Int. Cl.[5] ..... A46B 9/04

[52] U.S. Cl. ..... 15/167.1; 15/159 A; D4/104

[58] Field of Search ..... 15/167.1–167.3, 15/143 R, 106, 110, 186–188, 159 R, 160, 159 A, DIG. 5, 201, 149 R; D4/104–113, 127–138, 199; D24/10, 11; 16/110 R; 81/489; 128/62 A

[56] References Cited

U.S. PATENT DOCUMENTS

| | | | |
|---|---|---|---|
| D. 172,693 | 7/1954 | Wibbelsman . | |
| 1,382,681 | 6/1921 | Segal . | |
| 1,468,888 | 9/1923 | Stuart | 15/167.1 |
| 2,168,964 | 8/1939 | Strasser . | |
| 2,429,740 | 10/1947 | Aufsesser . | |
| 2,567,080 | 9/1951 | Pifer . | |
| 3,229,318 | 1/1966 | Clemens | 15/159 AU X |
| 3,359,588 | 12/1967 | Kobler . | |
| 3,722,020 | 3/1973 | Hills | 15/167.1 |
| 4,010,509 | 3/1977 | Huish | 15/167.1 |
| 4,033,008 | 7/1977 | Warren et al. . | |
| 4,051,571 | 10/1977 | Ayers | 15/143 RU X |
| 4,115,894 | 9/1978 | Peterson | 15/167.1 |
| 4,268,933 | 5/1981 | Papas . | |
| 4,288,883 | 9/1981 | Dolinsky . | |
| 4,519,111 | 5/1985 | Cavazza . | |
| 4,570,282 | 2/1986 | Kaufman et al. | 15/167.1 |
| 4,706,322 | 11/1987 | Nicolas | 15/106 |
| 4,729,142 | 3/1988 | Yoshioka . | |
| 4,776,054 | 10/1988 | Rauch | D4/104 X |
| 4,802,255 | 2/1989 | Breuer . | |
| 4,852,202 | 8/1989 | Ledwitz | 15/167.1 |

FOREIGN PATENT DOCUMENTS

| | | | |
|---|---|---|---|
| 525463 | 5/1956 | Belgium | 15/167.1 |

*Primary Examiner*—Philip R. Coe
*Assistant Examiner*—C. Cooley
*Attorney, Agent, or Firm*—Richard J. Ancel; Robert C. Sullivan; Murray M. Grill

[57] ABSTRACT

A toothbrush comprising a head having a flat surface facing upwardly, the head joined to a handle. The tufts of bristles are arranged in two groups of rows, each row extending transversely of the head. The rows of the first and second groups alternate with each other along the longitudinal axis of the head. In the first group, the two laterally outermost tufts of each row tilt sidewise towards their respective nearest side of the head, this tilt being about 12 degrees. The middle tuft of each of the second group extends substantially vertically upwardly from the head. The laterally outermost tufts of the second group tilt laterally inwardly toward each other by about 8 degrees. The tufts define three functional groups of tufts. The tuft arrangement is such that the cleaning action is substantially independent of any particular brushing technique employed by the user.

20 Claims, 3 Drawing Sheets

PLAQUE REMOVING TOOTHBRUSH

BACKGROUND OF THE INVENTION

This invention relates to a toothbrush construction, and more particularly to a toothbrush having its bristles as arranged as to be effective for the removal of plaque from teeth with manual brushing. The prior art is aware of a number of toothbrush constructions. However, none of the latter exhibits a tuft arrangement which performs several tooth and gumline cleaning functions regardless of the style or technique employed for brushing. While a number of toothbrush manufacturers print specific brushing techniques on their brush containers, if a purchaser does not pay attention to them, or forgets them, then less than optimum teeth cleaning results.

SUMMARY OF THE INVENTION

According to the practice of this invention, the tufts of a toothbrush are arranged on the head in rows to define distinct groups, with each of the rows being arranged substantially transversely to the longitudinal axis of the toothbrush head. A first row of tufts includes two pairs of laterally outermost tufts of bristles, each tuft of which tilts laterally outwardly toward the nearest side of the brush head.

A second row of tufts includes a central or middle tuft which is substantially perpendicular to the surface of the brush head and a pair of laterally outermost tufts, each of which are tilted laterally inwardly, towards the center of the head.

All of the tufts are generously spaced so as to allow independent and uninhibited movement of each tuft of bristles. The densely spaced bristle tuft configuration of conventional brush heads tend to move tangentially, push each other along and crowd each other out of inter-proximal spaces as they skid across tooth surfaces.

Laterally positioned tufts are angled inward and outward from the centerline of the brush head so as to create a series of uniform lines of bristle tips across the length of the brush head. Half of the angled tufts are tilted laterally outward so that they project into the gingival marginal area at the base of the crowns of the teeth. Half of the angled tufts are tilted laterally inward so that they project into embrasures and inter-proximal spaces between the teeth. This action occurs as downward force is applied to the brush head and is not dependent upon a non perpendicular orientation of the brush head relative to the tooth surfaces.

Tufts are oriented at multi-directional angles so that they are unable to structurally support one another as downward and horizontal force is applied to them by the user. Conventional, perpendicularly oriented bristle tufts tend to act as a series of columns and thus support suspended bristles as they pass over embrasures. The minimized overall compression strength afforded by this multi-directional angled configuration allows individual tufts of bristles to penetrate embrasures and inter-proximal spaces without being inhibited from doing so by surrounding bristle tufts.

Tufts are oriented at multi-directional angles so that they move in the direction of their angle. As downward and horizontal force is applied to the brush head, tufts of bristles will skid across tooth surfaces in the direction dictated by the angle in which they are anchored to the brush head rather than simply curl back in the opposite direction in which they are pushed. The present invention integrates multi-directional motion of bristles during unidirectional actuation of the brush.

When forced into the direction of their angle, bristles will spring out of crevasses as stresses are exceeded to contain them in place. This dynamic action will tend to fling plaque out of inter-proximal spaces. Conventional devices tend to pack plaque into spaces as bristle tufts sweep over embrasures.

The weak flexure strength of generously spaced angled bristle tufts of this invention allows for the reduction of bristle height without causing the sensation of increased bristle stiffness. Conventional brushes trimmed to the shorter height are perceptibly stiffer and tend to cause trauma to the mucosa. Minimized bristle height allows for greater clearance (and thus enhances reach to the rear molars) between the buccal surfaces of the teeth and the mucosal lining.

Angled tufts of bristles will assume varying heights as they are deformed, yet will appear uniform in height when not in use. Angled bristles will project above the tips of straight bristles as they are forced into a perpendicular orientation during use. This effect, caused by the greater length of the hypotenuse of a triangle, allows for the angled tufts to reach deeply into interproximal and gingival marginal areas as a perpendicular orientation is assumed.

DESCRIPTION OF THE PREFERRED EMBODIMENTS

Figure 1:
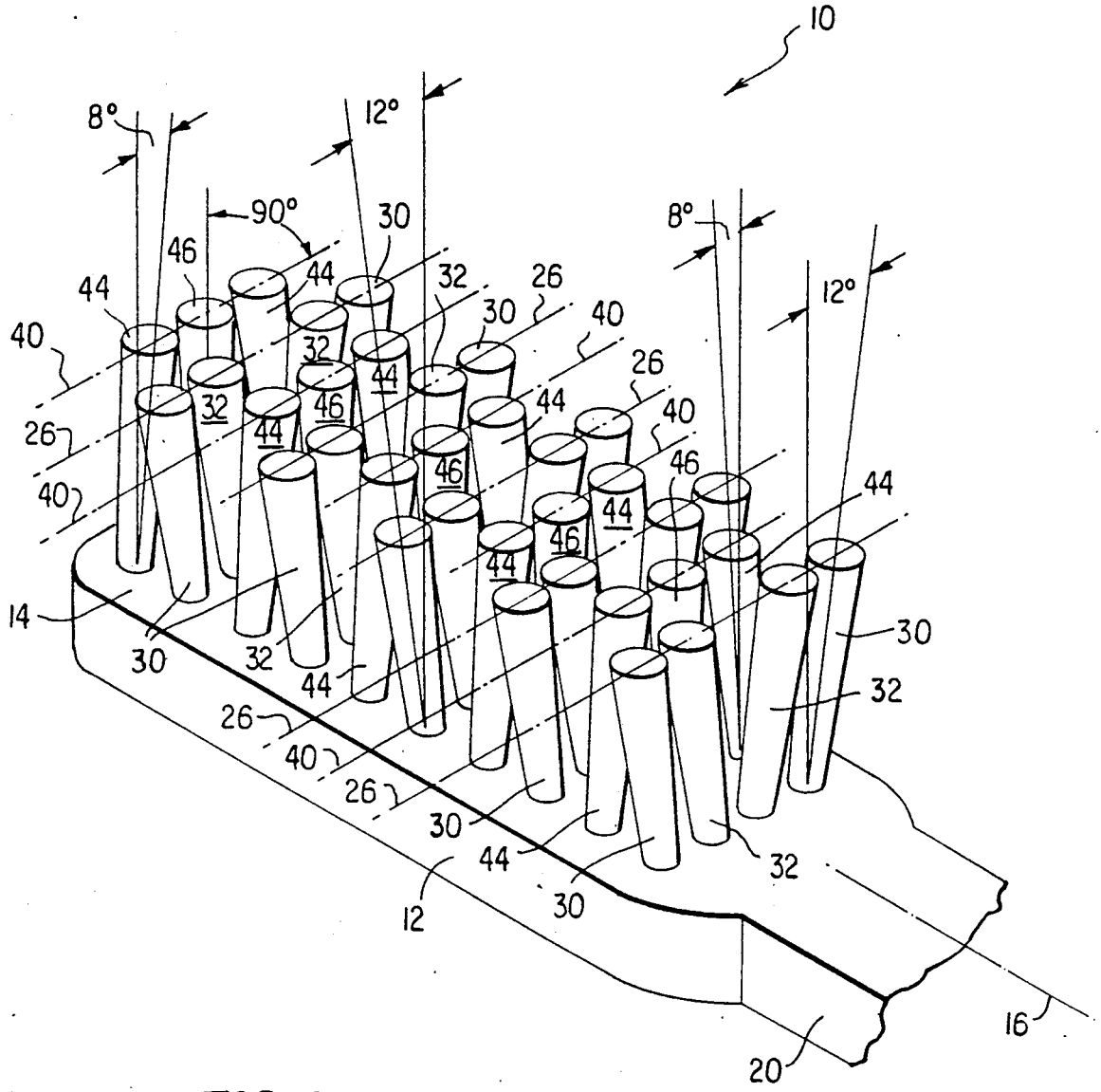
FIG. 1 is a partial perspective view of the head of a toothbrush formed in accordance with this invention.

Referring now to FIG. 1 of the drawings, the toothbrush 10 of this invention includes a head 12 having an upper flat surface 14. Head 12 is generally rectangular and integrally joined to a handle 20, only a portion of which is illustrated. The handle may be of conventional shape and forms no part of this invention. Typically, head 12 and handle 20 are integrally formed from a plastic material. The numeral 16 denotes the longitudinal axis of the head and may or may not coincide with the longitudinal axis of handle 20, although shown as coincident.

Rows 26 each include two pairs of laterally outermost tufts of bristles 30 and 32, each tuft of which slants laterally outwardly towards its nearest side of head 12. Tufts 30 and 32 lie in a single plane, this being the plane which contains row 26.

Preferably, tufts 30 and 32 of rows 26 tilt laterally about 12 degrees with respect to the vertical. Corresponding or homologous tufts in the remaining rows 26 tilt in the same manner.

Rows 40 include tufts 44, 46 and 44 which lie in a single plane. Tufts 46 are each substantially perpendicular to head surface 14 while tufts 44 tile inwardly towards the center of the head 12 by about 8 degrees.

It will be observed that rows 26 and 40 alternate along the longitudinal axis 16 of head 12. Row 40 is nearest the free end of the head farthest from the handle, as viewed at FIG. 1.

The two kinds of groups of tuft rows are each arranged on head 12 such that a plane, which contains axis 16 and which is at right angles to surface 14 and which longitudinally bisects head 12, also bisects middle tufts 46. Such a plane would not, however, intersect any tuft in those of the first row 26. It will be observed that all of the tufts of all of the rows are substantially the same height. In a typical construction, the height of the tufts as measured vertically of all the rows is about 0.375 inches with the longitudinal spacing as measured at the bottom of the tufts, between rows 26 and 40 being about 0.09 inches. The lateral spacing (widthwise) between tufts 30 and 32 is about 0.09 inches and between tufts 46 and 32 is about 0.057 inches. The lateral spacing between tufts 46 and 44 along any row 26 is about 0.135 inches. The base diameter of all tufts is about 0.050 inches. From a consideration of FIG. 1, it is seen that the bottoms of tufts 30 and the bottoms of tufts 44 are spaced substantially the same distance from respective sides of the head 12, i.e., substantially the same distance from a plane which contains axis 16 and which is at right angles to surface 14, and longitudinally bisects head 12 and middle tufts 46.

Figure 2:
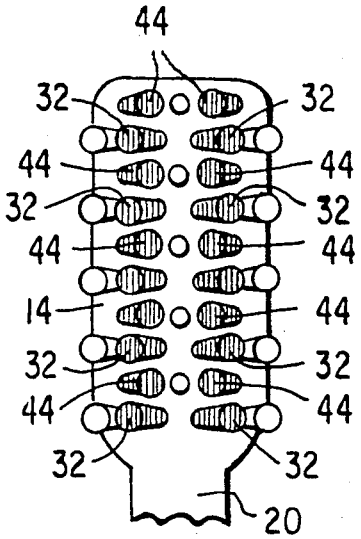
FIGS. 2 through 4 are plan views of the toothbrush of FIG. 1 and illustrate, with respective FIGS. *2a* to *4a*, the function of the several groups of tufts during their contact with teeth T and gums denoted at G.
Figure 3:
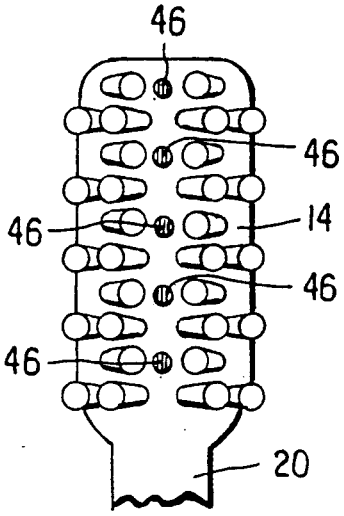
Figure 2A:
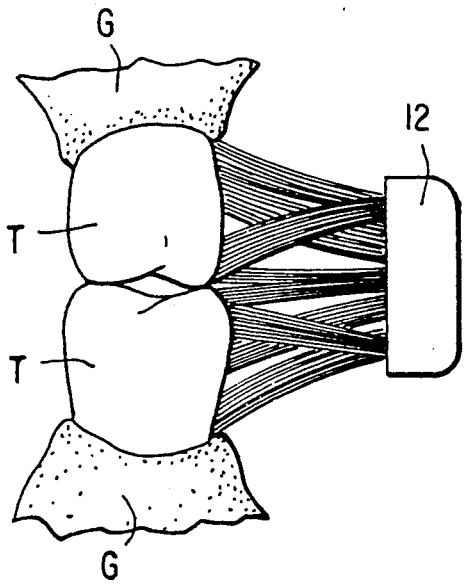
Figure 4:
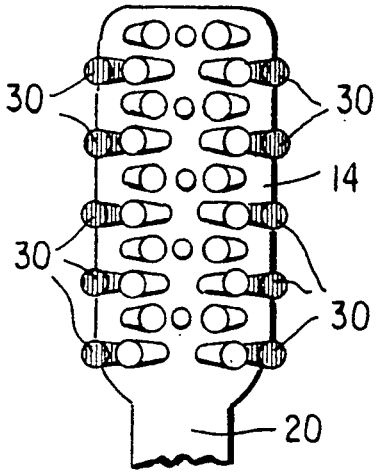

Referring to FIGS. 2 to 4 and their respective counterparts 2*a* to 4*a*, the specific cleaning functions of the tufts is illustrated. The several functional groups of tufts are highlighted by vertical hatching at FIGS. 2 to 4. In this following description, the tufts are described and grouped as to the functions they perform, while the previous description has described the tufts as related to the transverse rows they define, At FIGS. 2 and 2*a*, surface bristle tufts 32 and 44 clean the broad surfaces of the teeth with sets of generously spaced, oppositely acting and oppositely angled bristle tufts. As downward force and horizontal motion is applied to the brush head, surface bristle tips sweep along tooth surfaces in the direction of their angle rather than simply curl back in the opposite direction in which they are pushed. This dynamic action allows multidirectional motion of bristle tips during uni-directional actuation of the brush. Tufts of bristles are oriented at multidirectional angles so that they are unable to support one another as downward and horizontal force is applied to them by the user. The densely spaced, straight bristle tuft configuration of conventional brush heads tend to move tangentially and curl in the opposite direction in which they are pushed. As bristles curl away from the direction of the motion, less bristle tips come into direct contact with tooth surfaces. Tufts 44 of any row 40 tilt towards each other while tufts 32 of any adjacent row 26 tilts laterally outwardly.

Figure 3A:
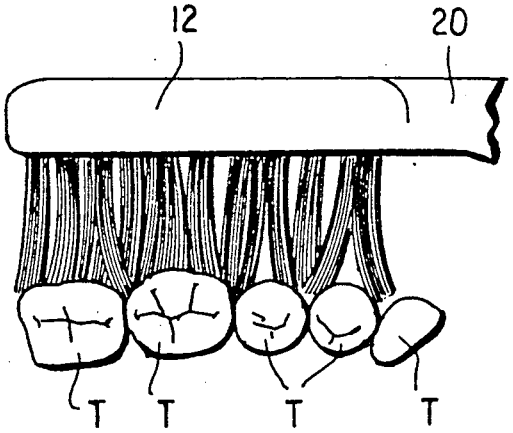

At FIGS. 3 and 3*a*, as the surrounding (non-highlighted) angled tufts of bristles yield to downward force, straight interproximal bristle tufts 46 deeply penetrate embrasures and interproximal spaces. These bristle tufts are arranged in a row along axis 16, with each tuft being perpendicular to the head surface. Conventional, perpendicularly oriented bristle tufts tend to act as a series of columns and thus support suspended bristles as they pass over embrasures. The combined compression strength of conventional straight bristle tufts inhibits individual tufts of bristles from penetrating interproximal spaces.

Figure 4A:
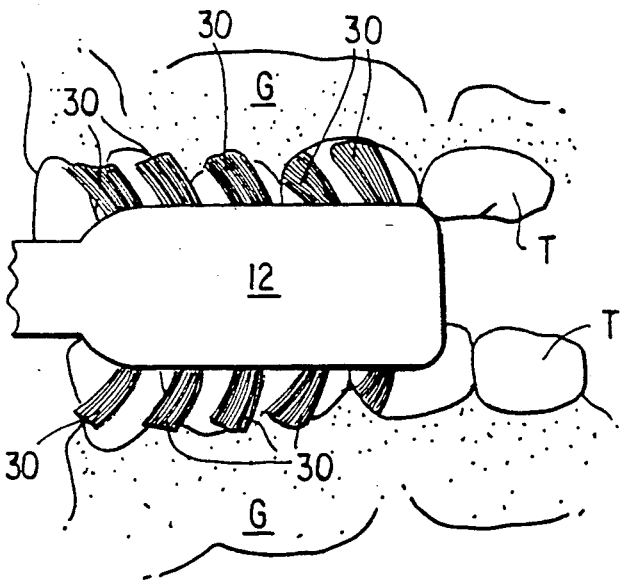

At FIGS. 4 and 4*a* perimeter bristle tufts, also termed gumline tufts 30 are tilted laterally outwardly along the sides of head 12 so that upon brushing they project toward the gingival marginal area at the base of the crowns of the teeth. As downward force is applied to the brush head, angled bristle tufts 30 tend to reach into the gingival margin as they move in the direction of their angle. Tufts 30 define two parallel rows along the sides of the head. Conventional straight tufted brushes require the user to orient the brush head at a 45 degree angle in order to access the gingival marginal area. When a conventional brush is oriented to optimize gingival marginal cleaning, other areas of the teeth are less effectively accessed.

There are thus three functional groups of bristle tufts in head 12 defined by the two types of rows 26 and 40. The rows 26 and 40 have been described as transverse to axis 16 with each of rows 26, 40 being identical. This arrangement yields the maximum cleaning action regardless of brushing technique.

We claim:

1. A toothbrush head, the head having a longitudinal axis and terminating in a free end, the head having a generally flat surface from which tufts of bristles extend generally upwardly, the tufts each having a bottom end attached to the brush head and a top portion terminating in a free end, the tufts being arranged in two groups of rows parallel to each other and spaced axially along the longitudinal axis of the had, wherein each row is transverse to said head longitudinal axis, the head having a plane vertically bisecting the brush head and which contains said head longitudinal axis, the tufts in the rows of the first group comprising an even number of tufts on one side of said plane and which tilt laterally away from said plane, and an identical even number of tufts which are on the other side of said plane and which tilt laterally away from said plane, the tufts in the rows of said second group of tufts comprising tufts, at least one of which is substantially perpendicular to said generally flat head surface and which is bisected by said plane, those tufts of said second group, which are placed outermost from the vertically bisecting plane, tilted inwardly toward said plane.

2. The toothbrush head of claim 1 wherein the second group of tufts comprises single rows of three tufts, the middle tuft being substantially at right angles to said head surface and bisected by said plane.

3. The toothbrush of claim 1 wherein each row of said first group of tufts comprises four tufts.

4. The toothbrush head of claim 1 wherein the laterally outermost tufts of said second group of tufts tilt laterally inwardly at an angle of about 8 degrees from said plane.

5. The toothbrush head of claim 1 wherein said tilt of the tufts of the first group is about 12 degrees from said plane.

6. The toothbrush head of claim 1 wherein a row of the second group of tufts is positioned nearest said head free end.

7. The toothbrush head of claim 1 wherein the rows of said first and second groups of tufts alternate in axial location along the longitudinal axis of the head.

8. The toothbrush head of claim 1 wherein the tufts of all of the rows are of substantially the same height as measured vertically from said generally flat surface from which the tufts extend.

9. A toothbrush head having a longitudinal axis and terminating in a free end, the head having a generally flat surface from which tufts of bristles extend generally upwardly, the head having a plane vertically bisecting the brush head and which contains said head longitudinal axis, the tufts defining (1) surface bristle tufts for cleaning the broad surfaces of teeth, said surface bristle tufts arranged in transverse, longitudinally spaced rows with the tufts of adjacent rows tilted alternately toward and away from said plane, (2) interproximal bristle tufts being perpendicular to the head surface and bisected by said plane, (3) gumline bristle tufts arranged in longitudinally spaced rows and tilting laterally outwardly away from said plane, said interproximal bristle tufts and said surface bristle tufts which tilt toward said plane positioned in respective transverse rows, said gumline bristle tufts and said surface bristle tufts which tilt away from said plane positioned in respective transverse rows.

10. The toothbrush head of claim 9 wherein the free ends of said gumline tufts (3) are positioned at a greater lateral distance from said plane than all the other free ends of the longitudinally placed rows of tufts.

11. The toothbrush head of claim 1 wherein the bottoms of the tufts of said first group which are placed outermost from the vertically bisecting plane and the bottoms of the tufts of the second group which are placed outermost from the vertically bisecting plane are positioned at substantially the same lateral distance from said plane.

12. The toothbrush head of claim 2 wherein the bottoms of the tufts of said first group which are placed outermost from the vertically bisecting plane and the bottoms of the tufts of the second group which are placed outermost from the vertically bisecting plane are positioned at substantially the same lateral distance from said plane.

13. The toothbrush head of claim 3 wherein the bottoms of the tufts of said first group which are placed outermost from the vertically bisecting plane and the bottoms of the tufts of the second group which are placed outermost from the vertically bisecting plane are positioned at substantially the same lateral distance from said plane.

14. The toothbrush head of claim 4 wherein the bottoms of the tufts of said first group which are placed outermost from the vertically bisecting plane and the bottoms of the tufts of the second group which are placed outermost from the vertically bisecting plane are positioned at substantially the same lateral distance from said plane.

15. The toothbrush head of claim 5 wherein the bottoms of the tufts of said first group which are placed outermost from the vertically bisecting plane and the bottoms of the tufts of the second group which are placed outermost from the vertically bisecting plane are positioned at substantially the same lateral distance from said plane.

16. The toothbrush head of claim 6 wherein the bottoms of the tufts of said first group which are placed outermost from the vertically bisecting plane and the bottoms of the tufts of the second group which are placed outermost from the vertically bisecting plane are positioned at substantially the same lateral distance from said plane.

17. The toothbrush head of claim 7 wherein the bottoms of the tufts of said first group which are placed outermost from the vertically bisecting plane and the bottoms of the tufts of the second group which are placed outermost from the vertically bisecting plane are positioned at substantially the same lateral distance from said plane.

18. The toothbrush head of claim 8 wherein the bottoms of the tufts of said first group which are placed outermost from the vertically bisecting plane and the bottoms of the tufts of the second group which are placed outermost from the vertically bisecting plane are positioned at substantially the same lateral distance from said plane.

19. The toothbrush head of claim 9 wherein the bottoms of said gumline bristle tufts (3) and the bottoms of the surface bristle tufts (1) which tilt toward said plane are positioned at substantially the same lateral distance from said plane.

20. The toothbrush head of claim 10 wherein the bottoms of said gumline bristle tufts (3) and the bottoms of the surface bristle tufts (1) which tilt toward said plane are positioned at substantially the same lateral distance from said plane.

* * * * *